United States Patent [19]

Brill

[11] Patent Number: 4,945,340

[45] Date of Patent: Jul. 31, 1990

[54] TAMPER-RESISTANT MAGNETIC SECURITY SYSTEM

[75] Inventor: Henry L. Brill, Flushing, N.Y.

[73] Assignee: Pittway Corporation, Syosset, N.Y.

[21] Appl. No.: 343,483

[22] Filed: Apr. 25, 1989

[51] Int. Cl.[5] ..... G08B 13/08

[52] U.S. Cl. ..... 340/547; 335/206; 335/207

[58] Field of Search ..... 340/547; 335/206, 207

[56] References Cited

U.S. PATENT DOCUMENTS

| | | | |
|---|---|---|---|
| 2,912,540 | 11/1959 | Sawicki | 340/547 |
| 3,668,576 | 6/1972 | Harman | 335/207 |
| 4,170,005 | 10/1979 | Duke | 340/547 |
| 4,210,889 | 7/1980 | Holce | 335/207 |
| 4,580,062 | 4/1986 | MacLaughlin | 340/547 |
| 4,661,805 | 4/1987 | Sälzer | 340/547 |
| 4,806,910 | 2/1989 | Sälzer | 340/547 |

*Primary Examiner*—Glen R. Swann, III

*Attorney, Agent, or Firm*—Fish & Richardson

[57] ABSTRACT

A security system for use in a physical security monitoring environment includes a switch unit having a common conductor, a guard conductor and at least three switches. Each of the switches has a deactivated condition and an activated condition and each is adapted to be placed in its activated condition in response to a magnetic field of predetermined magnetic flux. The switch unit also includes a logic circuit electrically interconnecting the switches and the common and guard conductors, the logic circuit completing a series circuit between the common conductor and the guard conductor whenever at least two predetermined but not all switches are in magnetically actuated condition. An associated actuator unit includes at least two permanent magnets and provides discrete magnetic fields of predetermined flux density and position sufficient to activate the two or more predetermined switches individually to complete the series circuit between the common conductor and the guard conductor when the actuator unit is located in predetermined juxtaposition with respect to the sensor unit.

17 Claims, 1 Drawing Sheet

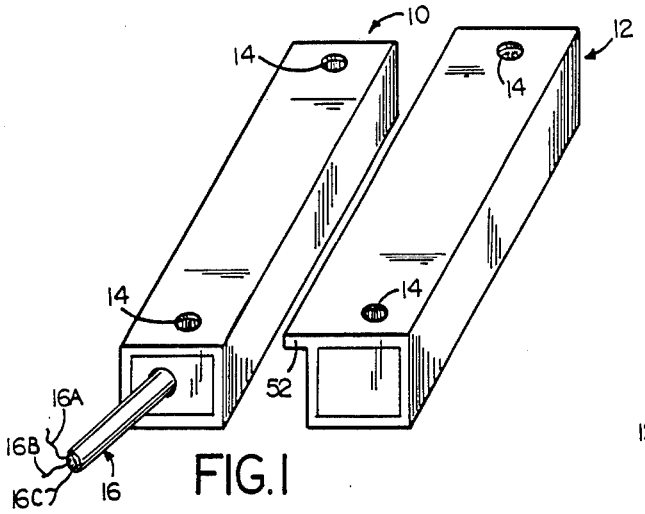
FIG.1
FIG.8
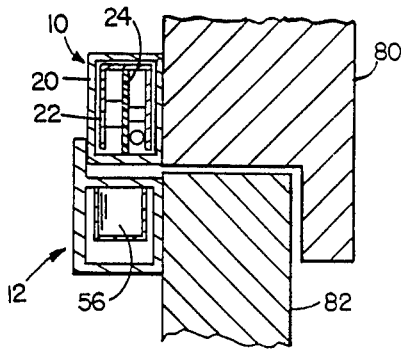
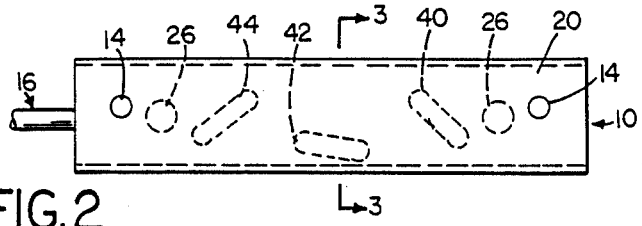
FIG.2
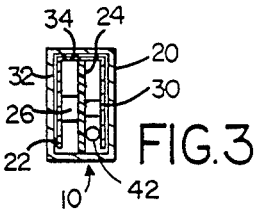
FIG.3
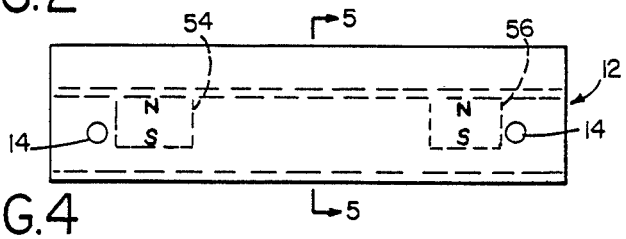
FIG.4
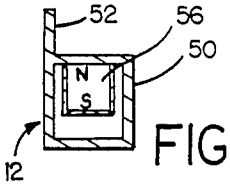
FIG.5
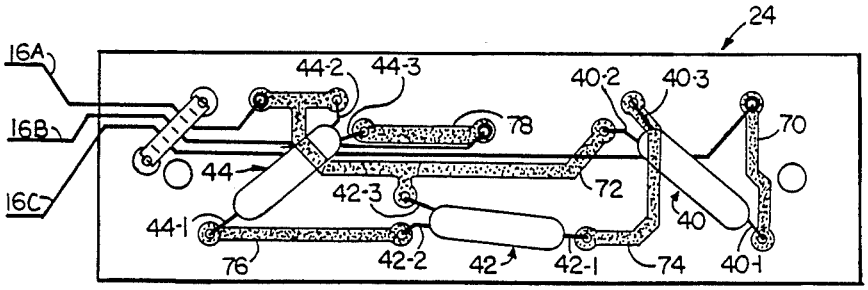
FIG.6
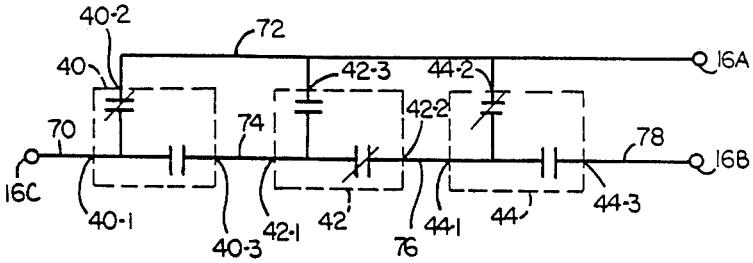
FIG.7

TAMPER-RESISTANT MAGNETIC SECURITY SYSTEM

BACKGROUND OF THE INVENTION

This invention relates to security systems and more particularly to magnetically actuated sensor arrangements for monitoring door or window openings or the like as a part of an electrically monitored physical security system.

In high security applications, reed switches are commonly used, and in previously known devices (for example, U.S. Pat. No. 4,210,889), balanced magnetically biased reed switches were assembled in a predetermined configuration, so that a deception of the device by the manipulation of outside magnets becomes difficult. However, magnetically biased high security switches have disadvantages that due to changes in the magnetic strength of the biasing magnets, and due to their inherent sensitivity, they may malfunction and cause false alarms. Furthermore, magnetically balanced switches are difficult to manufacture and are costly because the magnets must be magnetically balanced carefully, either during installation, or as preset at the factory.

SUMMARY OF THE INVENTION

In accordance with the invention, there is provided a security system for use in a physical security monitoring environment that includes a switch unit having a common conductor, a guard conductor and at least three switches. Each of the switches has a deactivated condition and an activated condition and each is adapted to be placed in its activated condition in response to a magnetic field of predetermined magnetic flux. The switch unit also includes a logic circuit electrically interconnecting the switches and the common and guard conductors, the logic circuit completing a series circuit between the common conductor and the guard conductor whenever at least two predetermined but not all switches are in magnetically actuated condition. An associated actuator unit includes at least two permanent magnets and provides discrete magnetic fields of predetermined flux density and position sufficient to activate the two or more predetermined switches individually to complete the series circuit between the common conductor and the guard conductor when the actuator unit is located in predetermined juxtaposition with respect to the sensor unit.

Preferably, the sensor unit and the actuator unit each include a sealed protective nonmagnetic housing; the switch unit further includes a magnetically permeable shield in which the switches are disposed; and the sensing unit switches are interconnected such that a series circuit to the guard conductor is completed when the actuator unit is appropriately positioned adjacent the sensor unit and that series circuit is interrupted and a shunt circuit to the alarm conductor is completed whenever the actuator unit is removed or a foreign magnetic field is introduced.

In preferred embodiments, the sensor unit also has an alarm conductor and the logic circuit electrically completes a circuit between the common conductor and the alarm conductor when either all of the switches are in magnetically actuated condition or fewer than two of the switches are in magnetically actuated condition.

In a particular embodiment, the sensor unit includes three switches and the actuator unit includes two permanent magnets, each permanent magnet being positioned to activate a corresponding switch such that only two of the three switches are activated to complete the series circuit between the common conductor and the guard conductor when the actuator unit is located in the predetermined juxtaposition. In that embodiment, each switch is a SPDT reed switch and the logic circuit includes a printed circuit board on which the reed switches are mounted, the three switches are spaced in a row along the length of the sensor unit, and the switches at both ends of the row are activated when the actuator unit is located in its predetermined juxtaposition, and the two permanent magnets are poled so that the middle switch unit remains in deactivated state.

The security system includes an arrangement of switch elements and logic circuitry that will interrupt a guard circuit when it is disturbed by the presence of a foreign magnetic field. The switch units of the logic circuit and the magnets of the actuator unit are spaced apart in coordinated array so that the flux pattern from the cooperating magnetic actuator will only actuate specific switch units.

BRIEF DESCRIPTION OF THE DRAWING

Other features and advantages will be seen as the following description of a particular embodiment progresses, in conjunction with the drawings, in which:

FIG. 1 is a perspective view of a sensor unit and an actuator unit, in accordance with the invention;

FIG. 2 is a front elevational view of the sensor unit shown in FIG. 1;

FIG. 3 is a sectional view taken the line 3—3 of FIG. 2;

FIG. 4 is a front elevational view of the actuator unit that cooperates with the sensor unit of FIG. 2;

FIG. 5 is a sectional view taken along the line 5—5 of FIG. 4;

FIG. 6 is a view of the printed circuit board employed in the sensor unit shown in FIGS. 2 and 3;

FIG. 7 is a schematic diagram of circuitry in the sensor unit showing the switch units in deactivated states; and FIG. 8 is a diagrammatic showing of the sensor and actuator units mounted on a door opening.

DESCRIPTION OF PARTICULAR EMBODIMENT

Shown in FIG. 1 is a sensor unit 10 and a cooperating actuator unit 12, each of which has mounting holes 14 for mounting in juxtaposed relation on portions of a building opening such as a door, window or the like. Unit 10 has armored cable 16 in which alarm conductor 16A, guard conductor 16B and common conductor 16C are disposed.

Further details of the sensor unit 10 may be seen with reference to FIGS. 2 and 3. That sensor unit includes aluminum housing 20 in which U-shaped soft iron shield 22 and printed circuit board 24 are disposed, circuit board 24 being supported by spacers 26. Aluminum housing 20 has a length of about eleven centimeters, a width of about 1.7 centimeters, a depth of about 2.5 centimeters, and a wall thickness of about one millimeter. Shield 22 has parallel legs 30, 32 and base 34 each of about one millimeter thickness and is mounted in positioned so its open side faces actuator 12 (as indicated in FIG. 8). Centrally positioned within shield 22 by spacers 26 is printed circuit board 24 which carries an array of printed circuit conductors that are connected to the conductors of cable 16 and on which are mounted three magnetically actuated reed switches 40, 42, 44. Each reed switch is of the single pole double throw (SPDT) type and has a common terminal -1, a normally closed contact terminal -2 and a normally open contact terminal -3 (see FIGS. 6 and 7). Housing 20 is filled with potting compound and conductor leads 16 are protected by the flexible steel sheath of cable 16.

Further details of actuator unit 14 may be seen with reference to FIGS. 4 and 5. Unit 14 includes housing 50 of aluminum about one millimeter thick with internal dimensions of about 1.8 centimeters width, about 1.5 centimeters depth and about eleven centimeters length. Flange 52 projects about one half centimeter. Disposed within housing 50 are cylindrical magnets 54, 56. Each magnet 54, 56 is of barium ferrite that has a coercive force of about 2400 oresteds, a diameter of about 1.5 centimeters and a height of about 0.9 centimeter. Each magnet is magnetized in the axial direction, and they are positioned in the same magnetic orientation opposite reed switches 40 and 44 (as indicated in FIGS. 2 and 4) such that their magnetic fields oppose each other in the region centered between them so that the net flux is zero and the center reed switch 42 is not affected.

The plan view of printed circuit board 24 shown in FIG. 6 indicates the location of switches 40, 42 and 44 and circuit wiring on that circuit board.

The interconnection of switches 40, 42 and 44 is indicated in FIGS. 6 and 7. Common or input conductor 16C is connected via printed circuit conductor 70 to common terminal 40-1 of reed switch 40. Normally closed terminal 40-2 of reed switch 40 is connected to conductor 72 and normally open terminal 40-3 is connected to conductor 74. Conductor 72 is connected to normally open terminal 42-3 of switch 42, normally closed terminal 44-2 of switch 44, and alarm line 16A. Printed circuit conductor 74 is connected to common terminal 42-1 of reed switch 42. Normally closed terminal 42-2 of reed switch 42 is connected to common terminal 44-1 of switch 44 by conductor 76, and normally open terminal 44-3 of switch 44 is connected by conductor 78 to guard conductor 16B. Thus, the normally open contacts of switches 40 and 44 and the normally closed contacts of switch 42 are in a series circuit; and the normally open contacts of switch 42 and the normally closed contacts of switches 40 and 44 are in shunt with conductor 72.

The circuit of FIG. 7 shows the reed switches 40, 42 and 44 in their deactivated positon (e.g., when actuator unit 12 is spaced from sensor unit 10). When the switch unit 10 is properly installed on a door frame 80 (as indicated in FIG. 8) and the door 82 to which the actuator unit 12 is attached is in closed position, magnets 54 and 56 actuate reed switches 40 and 44, respectively, opening normally closed contacts 40-2 and closing contacts 40-3 of switch 40; and opening contacts 44-2 and closing contacts 44-3 of switch unit 44, thus interrupting the circuit from common conductor 16C to alarm conductor 16A. As center switch 42 is not activated, a series circuit between conductor 16C and guard conductor 16B is completed—signaling that the monitored door 82 is closed.

If the door 82 is not in its closed position or if an attempt is made to defeat the security device using one or more magnets, one or more of the reed switches 40, 42, 44 will change state. In such case, the closed loop monitoring circuit between guard conductor 16B and common conductor 16C will be opened and a circuit will be completed to the alarm conductor 16A to provide a signal to the security system control. For example, if magnetic switches 40 and 42 or if all three magnetic switches are operated, switch 42 will have its normally closed contacts 42-2 opened and its normally open contacts 42-3 closed to complete a circuit from conductor 16C through normally open contacts 40-3 and 42-3 of switches 40 and 42 to conductor 72 and alarm conductor 16A. Similarly, if none of the magnetic switch units are actuated, the normally open contacts 40-3 of switch unit 40 will interrupt the monitoring circuit between conductors 16B and 16C, and conductor 16C will be connected to alarm conductor 16A through the normally closed contacts 40-2 of switch 40 and conductor 72.

While a particular embodiment of the invention has been shown and described, various modifications thereof will be apparent to those skilled in the art, and therefore it is not intended that the invention be limited to the disclosed embodiment or to details thereof, and departures may be made therefrom within the spirit and scope of the invention.

What is claimed is:

1. A security system for use in a physical security monitoring environment, said system comprising a sensor unit having a common conductor, an alarm conductor, and a guard conductor and at least three switches, each of said switches having a deactivated condition and an activated condition and being adapted to be placed in its activated condition in response to a magnetic field of predetermined magnetic flux density;

said sensor unit having a logic circuit electrically interconnecting said switches and said common conductor, said alarm conductor and said guard conductor, said logic circuit completing a series circuit between said common conductor and said guard conductor whenever a predetermined one of said switches is in a deactivated condition and the remaining switches are in an activated condition, and completing a circuit between said common conductor and said alarm conductor when either all of said switches are in an activated condition or one of said remaining switches is in a deactivated condition; and an actuator unit with at least two permanent magnets, the number of said permanent magnets being one less than the number of said switches and each said permanent magnet providing a discrete magnetic field of predetermined flux density sufficient to activate a corresponding one of said switches when said actuator unit is located in a predetermined juxtaposition with respect to said sensor unit.

2. The security system of claim 1 wherein two of said magnets are spaced so that said predetermined one of said switches of said sensor unit is located between said two magnets when said actuator unit is located in said predetermined juxtaposition to said sensor unit, said two magnets being poled so that their magnetic fields oppose and said one switch is not magnetically activated, and said series circuit to said guard conductor is completed.

3. The security system of claim 1 wherein said circuit between said common conductor and said alarm conductor is completed when said series circuit is interrupted.

4. The security system of claim 3 wherein two of said magnets are spaced so that said predetermined one of said switches of said sensor unit is located between said two magnets when said actuator unit is located in said predetermined juxtaposition to said sensor unit, said two magnets being poled so that their magnetic fields oppose and said one switch is not magnetically activated.

5. The security system of claim 1 wherein said sensor unit and said actuator unit each include a sealed protective nonmagnetic housing.

6. The security system of claim 1 wherein said sensor unit further includes a magnetically permeable shield in which said switches are disposed.

7. The security system of claim 1 wherein each said switch is a SPDT reed switch.

8. The security system of claim 7 wherein said sensor unit and said actuator unit each include a sealed protective nonmagnetic housing, and said sensor unit further includes a magnetically permeable shield in which said switches are disposed.

9. The security system of claim 8 wherein two of said magnets are spaced so that said predetermined one of said switches of said sensor unit is located between said two magnets when said actuator unit is located in said predetermined juxtaposition to said sensor unit, said two magnets being poled so that their magnetic fields oppose and said one switch is not magnetically activated, and said series circuit to said guard conductor is completed.

10. The security system of claim 9 wherein said logic circuit completes a circuit between said common conductor and said alarm conductor when said series circuit is interrupted.

11. A security system for use in a physical security monitoring environment, said system comprising a sensor unit having a common conductor, an alarm conductor, and a guard conductor and three switches, each of said switches having a deactivated condition and an activated condition and being adapted to be placed in its activated condition in response to a magnetic field of predetermined magnetic flux density;

said sensor unit having a logic circuit electrically interconnecting said switches and said common conductor, said alarm conductor and said guard conductor, said logic circuit completing a series circuit between said common conductor and said guard conductor whenever a predetermined one of said switches is in a deactivated condition and the other two switches are in an activated condition, and completing a circuit between said common conductor and said alarm conductor when either all of said switches are in an activated condition or one of said other two switches is in a deactivated condition; and an actuator unit including two permanent magnets, each said permanent magnet being positioned to activate a corresponding switch such that only two of said three switches are activated to complete said series circuit between said common conductor and said guard conductor when said actuator unit is located in a predetermined juxtaposition with respect to said sensor unit.

12. The security system of claim 11 wherein said three switches are spaced in a row along the length of said sensor unit, and the switches at either end of said row are activated when said actuator unit is located in said predetermined juxtaposition and the middle switch remains in a deactivated state.

13. The security system of claim 12 wherein each said switch is a SPDT reed switch and said logic circuit includes a printed circuit board on which said reed switches are mounted.

14. The security system of claim 12 wherein said sensor unit further includes a magnetically permeable shield in which said switches are disposed.

15. The security system of claim 12 wherein said sensor unit and said actuator unit each include a sealed protective nonmagnetic housing.

16. The security system of claim 15 wherein two of said magnets are spaced so that one switch of said sensor unit is located between said two magnets when said actuator unit is located in said predetermined juxtaposition to said sensor unit, said two magnets being poled so that their magnetic fields oppose and said one switch is not magnetically activated, and said series circuit to said guard conductor is completed.

17. The security system of claim 16 wherein said circuit between said common conductor and said alarm conductor is completed when said series circuit is interrupted.

* * * * *